US005884263A

United States Patent [19]

Aaron et al.

[11] Patent Number: 5,884,263

[45] Date of Patent: Mar. 16, 1999

[54] COMPUTER NOTE FACILITY FOR DOCUMENTING SPEECH TRAINING

[75] Inventors: Joseph David Aaron; Frances Ann Hayden; Catherine Keefauver Laws; Robert Bruce Mahaffey, all of Austin, Tex.

[73] Assignee: International Business Machines Corporation, Armonk, N.Y.

[21] Appl. No.: 710,149

[22] Filed: Sep. 16, 1996

[51] Int. Cl.[6] ..... G10L 3/00

[52] U.S. Cl. ..... 704/270; 704/271

[58] Field of Search ..... 704/260, 201, 704/262, 251, 270, 254, 258, 261, 267, 268, 275

[56] References Cited

U.S. PATENT DOCUMENTS

| | | | |
|---|---|---|---|
| 4,406,626 | 9/1983 | Anderson et al. | 704/260 |
| 4,415,767 | 11/1983 | Gill et al. | 704/243 |
| 4,860,360 | 8/1989 | Boggs | 704/233 |
| 5,163,085 | 11/1992 | Sweet et al. | 379/88.19 |
| 5,208,745 | 5/1993 | Quentin et al. | 364/188 |
| 5,303,327 | 4/1994 | Sturner et al. | 704/270 |
| 5,313,531 | 5/1994 | Jackson | 704/243 |
| 5,396,577 | 3/1995 | Oikawa et al. | 704/260 |
| 5,429,513 | 7/1995 | Diaz-Plaza | 434/167 |
| 5,526,407 | 6/1996 | Russell et al. | 379/89 |
| 5,536,171 | 7/1996 | Javkin et al. | 434/185 |
| 5,636,325 | 6/1997 | Farrett | 704/258 |
| 5,717,828 | 2/1998 | Rothenberg | 704/270 |

OTHER PUBLICATIONS

IBM Technical Disclosure Bulletin, vol. 38, No. 12 Dec. 1995, Techniques for Speech Recognition.

IBM Technical Disclosure Bulletin, vol. 38 No. 02, Feb. 1995, Specialized Language Models for Speech Recognition.

IBM Technical Disclosure Bulletin, vol. 37 No. 10 Oct. 1994, Speech–Recognition System Enrollment Program with Training Features.

IBM Technical Disclosure Bulletin, vol. 36 No. 02 Feb. 1993, Method of Establishing Connections in the Client–SErver Model of Tangora.

IBN Technical Disclosure Bulletin vol. 39 No. 01 Jan. 1996, Multitasking System for Recognizing Speech Commands.

*Primary Examiner*—Richemond Dorvil
*Attorney, Agent, or Firm*—Jeffrey S. LaBaw

[57] ABSTRACT

A note facility which documents the progress of a student in producing human speech. The facility stores a set of notes in a note file in a computer memory. Each of the set of notes contains textual information generally descriptive of the human speech produced at a given time during the training. A set of speech samples is also stored and attached to selected ones of the set of notes. Each of the speech samples is a digitized version of the human speech produced. The facility analyzes the human speech produced at least one of the given times to produce speech statistics which are presented to the user interface. The speech statistics can be stored in a note and the statistics note attached to the set of notes containing the descriptive text. Navigation through the note file can review each of the notes for the subjective opinion of the student's progress, statistics of an objective acoustic analysis of the speech and listen to the speech file on which the opinion is based. The facility creates reports by allowing the user to select particular notes within the set of notes for inclusion in the report. When the report function is invoked, the selected notes are incorporated within the report.

22 Claims, 13 Drawing Sheets

FIG. 7

SpeechViewer III Report

Client ID : STUDENT1 Clinician ID: COMMON

Client Name: Student #1

201

Exercise: Pitch & Loudness Note: 4 of 6
Date: 07-02-1996 Time: 02:22 PM
Data:
This is a sample of speech that represents student1 in initial attempts to use pitch range to create inflection. Pitch range is flat.

*If data were attached it would appear here*
*If speech file were attached it would be referenced here*

203

Exercise : Pitch & Loudness Note: 6 of 6
Date: 07-02-1996 Time: 02:26 PM
Data:
This could be a summary note after weeks of therapy.

205

COMPUTER NOTE FACILITY FOR DOCUMENTING SPEECH TRAINING

BACKGROUND OF THE INVENTION

This invention relates generally to analysis of human speech. More particularly, it relates to a note taking function which allows speech professionals to document the progress of a student by generating a report which includes written description, speech statistics and speech samples.

There are several professions in which speech professionals make assessments of the accuracy and progress in producing particular types of human speech. Speech pathologists are professionals who work with individuals who do not speak in a "normal" manner. This may be due to various speech impediments or physical deficiencies which impair these individuals' abilities to produce what would be considered normal human speech. Typically, a speech pathologist will work with such an individual over a period of time to teach him how to more accurately produce the desired sounds. Similarly, language coaches teach a student a foreign language, with the proper accent and so forth. Actors frequently use dialect coaches; professional singers take voice lessons. Although the type of speech and sounds vary within the particular disciplines of these specialties, they share common thread in that human speech is made and, through a series of lessons, hopely improved.

Like many tasks in today's society, computers and computer software have provided important tools to improve these processes. SpeechViewer is an IBM product that provides analytical feedback about speech production. It is used by Speech and Language Pathologists, Teachers of the Deaf, and other professionals who work with voice, dialect, foreign languages, and singing. SpeechViewer computes acoustic analyses, such as fundamental frequency, signal intensity, and spectral information and transforms the data into animated graphical feedback that varies as functions of sound.

While the professionals using the product were pleased with various analysis functions provided in prior versions of the product, SpeechViewer lacked features helpful in documenting the findings which were made through the use of the product. For example, speech pathologists are usually obligated to maintain detailed clinical notes for the purposes of charting patient progress. In the public school environment, Individualized Education Plans (IEPs) must be filed to identify the characteristics of a student's disability, the objectives of planned remediation, the outcome of that remediation, and planning of future remediation services. For non-school services that are paid by 3rd party payers, such as insurance companies and Medicare, equivalent documentation is required to justify the quality of care for compensation. Even when the speech professional was not obligated to produce a report, e.g., private voice lessons, such a capability might be welcome.

Until the present invention, speech professionals typically relied on manual documentation, i.e. pencil-and-paper procedures. While more general purpose applications such as word processors can be used to generate reports, they did not provide any means of providing speech analysis. No single tool was available which could analyze speech, gather information and present it in a report format.

The present invention provides a solution to this problem.

SUMMARY OF THE INVENTION

Therefore, it is an object of the invention to integrate the speech analysis and documentation used in clinics and schools in a single automated procedure.

It is another object of the invention to emulate a set of index cards for taking notes.

It is another object of the invention to select information from these cards for inclusion in a report.

It is another object of the invention to attach captured speech samples to a note for playback in reviewing the notes.

It is another object of the invention to capture data from clinical exercises and attach the data to a note.

It is another object of the invention to embed the attached speech samples and clinical data into a clinical report that can be printed or included in another report.

These objects and others are accomplished by a note facility which documents the progress of a student in producing human speech. The facility creates and stores a set of notes in a note file in a computer memory. Each of the set of notes contains textual information generally descriptive of the human speech produced at a particular time during the training. A set of speech samples is also stored and attached to selected ones of the set of notes. Each of the speech samples is a digitized version of the human speech produced. Thus, the teacher can navigate through the note file, review each of the notes for the subjective opinion of the student's progress and listen to the speech file on which the opinion is based.

The facility analyzes the human speech produced at least once during the training to produce speech statistics which are presented to the user interface. The speech statistics can be stored in a note and the statistics note attached to the set of notes containing the descriptive text.

The facility creates reports to further document the student's progress. When creating a report, a user may select particular notes within the set of notes for possible inclusion in the report. When the report function is invoked, the selected notes are incorporated within the report.

BRIEF DESCRIPTION OF THE DRAWINGS

These objects, features and advantages will be more readily understood with reference to the attached figures and following description.

FIG. 7 is a sample report which might be generated by use of the present invention.

DETAILED DESCRIPTION OF THE PREFERRED EMBODIMENT

The invention may be run on a variety of computers or collection of computers under a number of different operating systems. The computer could be, for example, a personal computer, a mini computer, mainframe computer or a computer running in a distributed network of other computers. Although the specific choice of computer is limited only by processor speed and disk storage requirements, computers in the IBM PC series of computers could be used in the present invention. For additional information on IBM's PC series of computers, the reader is referred to *IBM PC* 300/700 *Series Hardware Maintenance* Publication No. S83G-7789-03 and *User's Handbook IBM PC Series* 300 and 700 Publication No. S83G-9822-00. One operating system which an IBM personal computer may run is IBM's OS/2 Warp 3.0. For more information on the IBM OS/2 Warp 3.0 Operating System, the reader is referred to *OS*/2 Warp V3 *Technical Library* Publication No. GBOF-7116-00.

In the alternative, the computer system might be in the IBM RISC System/6000 (TM) line of computers which run on the AIX (TM) operating system. The various models of the RISC System/6000 is described in many publications of the IBM Corporation for example, *RISC System*/6000, 7073 *and* 7016 *POWERstation and POWERserver Hardware Technical* reference, Order No. SA23-2644-00. The AIX operating system is described in *General Concepts and Procedure— AIX for RISC System*/6000 Publication No. SC23-2202-02 as well as other publications of the IBM Corporation.

Figure 1:
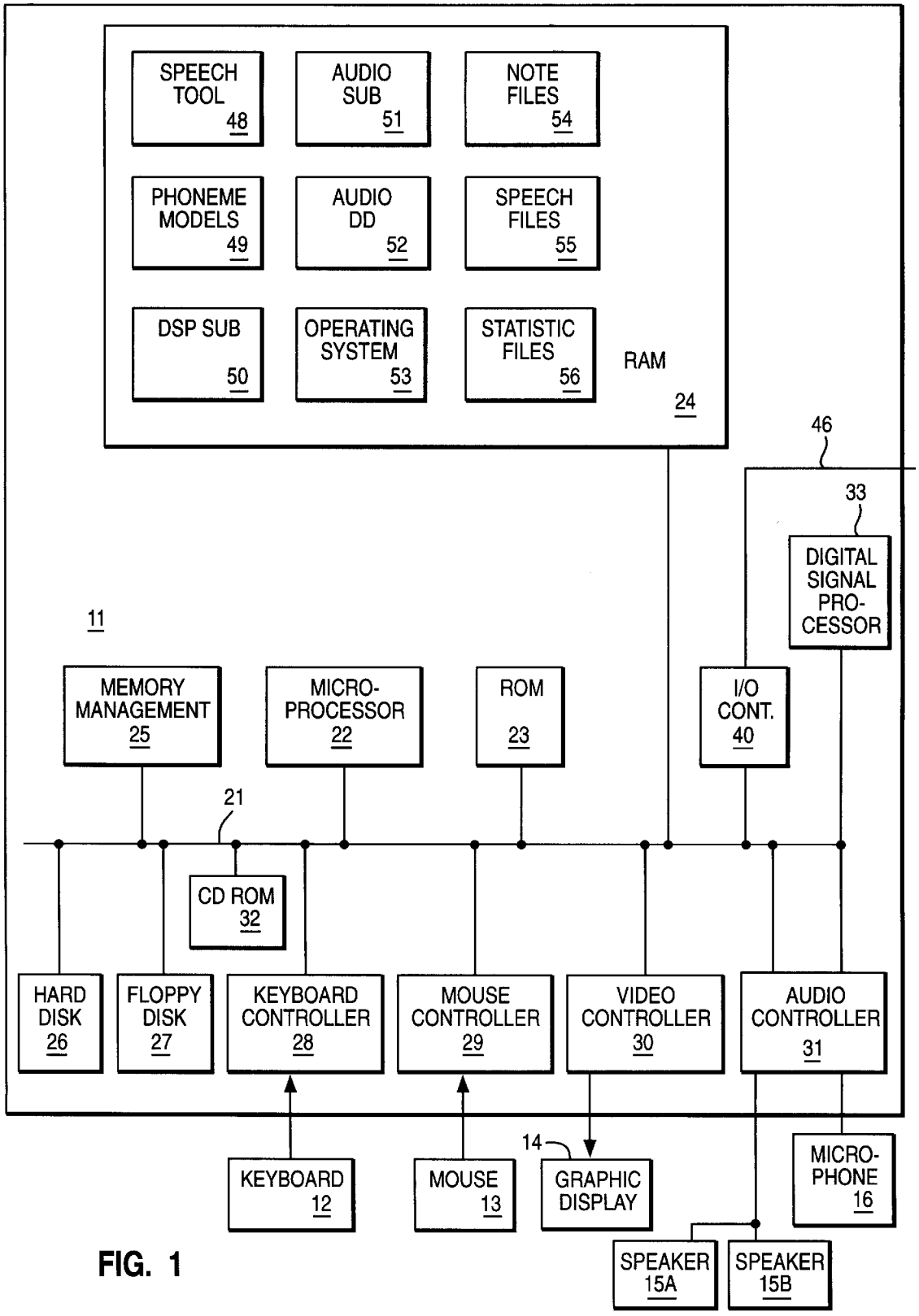
FIG. 1 depicts a computer system configured according to the teachings of the present invention.

In FIG. 1, a computer 10, comprising a system unit 11, a keyboard 12, a mouse 13 and a display 14 are depicted in block diagram form. The system unit 11 includes a system bus or plurality of system buses 21 to which various components are coupled and by which communication between the various components is accomplished. The microprocessor 22 is connected to the system bus 21 and is supported by read only memory (ROM) 23 and random access memory (RAM) 24 also connected to system bus 21. A microprocessor in the IBM PC series of computers is one of the Intel family of microprocessors including the 386, 486 or Pentium microprocessors. However, other microprocessors including, but not limited to, Motorola's family of microprocessors such as the 68000, 68020 or the 68030 microprocessors and various Reduced Instruction Set Computer (RISC) microprocessors such as the PowerPC chip manufactured by IBM, or other RISC microprocessors made by Hewlett Packard, Sun, Motorola and others may be used in the specific computer.

The ROM 23 contains among other code the Basic Input-Output system (BIOS) which controls basic hardware operations such as the interaction and the disk drives and the keyboard. The RAM 24 is the main memory into which the operating system and application programs are loaded. The memory management chip 25 is connected to the system bus 21 and controls direct memory access operations including, passing data between the RAM 24 and hard disk drive 26 and floppy disk drive 27. The CD ROM 32 also coupled to the system bus 21 is used to store a large amount of data, e.g., a multimedia program or presentation.

Also connected to this system bus 21 are various I/O controllers: The keyboard controller 28, the mouse controller 29, the video controller 30, and the audio controller 31. As might be expected, the keyboard controller 28 provides the hardware interface for the keyboard 12, the mouse controller 29 provides the hardware interface for mouse 13, the video controller 30 is the hardware interface for the display 14, and the audio controller 31 is the hardware interface for the speakers 15. An I/O controller 40 such as a Token Ring Adapter enables communication over a network 46 to other similarly configured data processing systems.

One of the preferred implementations of the invention is as sets of instructions 48–56 resident in the random access memory 24 of one or more computer systems configured generally as described above. Until required by the computer system, the set of instructions may be stored in another computer memory, for example, in the hard disk drive 26, or in a removable memory such as an optical disk for eventual use in the CD-ROM 32 or in a floppy disk for eventual use in the floppy disk drive 27. One skilled in the art would appreciate that the physical storage of the sets of instructions physically changes the medium upon which it is stored electrically, magnetically, or chemically so that the medium carries computer readable information. While it is convenient to describe the invention in terms of instructions, symbols, characters, or the like, the reader should remember that all of these and similar terms should be associated with the appropriate physical elements.

Further, the invention is often described in terms of selecting or determining, or other terms that could be associated with a human operator. Although the system will often respond to or analyze human input, no action by a human operator is desirable in any of the operations described herein which form part of the present invention. The operations are machine operations processing electrical signals to generate other electrical signals.

The note facility of the present invention is an important improvement to the art of computer aided speech training. As a major impetus of the invention was to provide a replacement for clinical documentation, to do so the present invention needed to provide at least the properties of existing clinical documentation. For example, through the notes interface, the invention allows the teacher to document the nature of the disorder and stating clinical objectives for remediation. During remediation, the teacher documents progress with notes, data, and speech samples. Reports are generated, either as stand alone reports or integrated into a larger report. Although the illustrative embodiment described below is couched in terms of a speech therapy tool, the invention also encompasses other types of speech training such as dialect coaching, foreign language learning and vocal training. The types of exercises provided by each type of tool would differ, however, the principles of the invention are useful for all.

The process of the preferred embodiment of the invention generally begins when a student or a client, generally "client" hereafter, is registered to the system. A subdirectory for the client under the main directory of the speech tool on the hard disk or on a removable diskette is created. One skilled in the art would recognize that other data structures are readily modifiable for keeping the client data according to the present invention. The prefix, "XXX", represents the subdirectory name. The subdirectory is to used to store the client profiles, data, voice files, and clinical notes associated with a given client.

After registration, a client may log onto the speech tool using the subdirectory name as his/her client ID. The act of logging on would automatically link the tool and the user interface with the client's subdirectory. The therapist's ID provides access to the notes facility for the purposes of confidentiality and access control. Simple dialog boxes containing entry fields may be used as the user interface in which to input the client and therapist IDs. The use of therapist's ID prevents unauthorized tampering with the data of a given student, providing a sort of electronic signature that the data is verified.

One of the files stored in the subdirectory is a client profile, e.g., a file called XXX.CLI. The contents of the client profile generally comprise personal information about the student plus operating parameters to be used with the client. For example, the client profile can comprise data such as a client ID, client name, clinician, client's pitch range and so forth. The client profile may also include a selected set of speech tool settings for the client. For example, a setting to create audio and video reinforcement, e.g., SHAZAAM!!, might be appropriate for a child when a phoneme is produced correctly, however, for an adult client such reinforcement might be viewed as a distraction to the training.

Another of the files which is typically created in the subdirectory is a note file. When client textual notes are created by the clinician, the note file, an XXX.NOT file, is created in the client's subdirectory. The note file comprises a set of notes which comprise text data. A first note is stored in the file to which is appended new notes when added to the particular set of notes. According to the present invention, the XXX.NOT file may contain pointers or other references to attached voice files and attached statistic files. Alternatively, and in the embodiment described below, the statistics are copied into a note in the note file. The ability to append or otherwise incorporate voice and statistic files in the note file allows the present invention to effectively convey the progress of the student in attaining the desired goal. The ability to playback the voice file or analyze the objective speech statistics provides a valuable reinforcement of the subjective opinions of the therapist which was not available in the pencil and paper reports of the prior art. The invention also allows the teacher to set up different sets of notes for different exercises to document the student's progress in each exercise.

At least some of the information in the note file is also common to the user interface. Referring to one preferred embodiment of the interface in FIG. 2, each of the notes in the note file contains the following information:

A Client ID (XXX) 101

The Date 102 and Time 103 that the note was created

A Client name or description 105

A 600 character scrollable entry field for the note text 107.

A note status field 109 that indicates that a note is new and whether or not a note is selected for inclusion in a report.

An index 111 to show the location of the individual note in a stack of notes, e.g., "4 of 6".

A name of the exercise 113 from which note was created.

The interface also has a number of controls shown as pushbuttons which allow the user to access some of the functions provided by the invention. One skilled in the art would recognize that other controls such as menus or check boxes could be used. The Save pushbutton 115 allows the user to save the note or the changes to the note in the note file. The Cancel pushbutton 117 allows the user cancel a new note or cancel the changes to an existing note. The Help pushbutton 119 invokes help for the note function. The speech sample file pushbutton 121 invokes a dialog box wherein a user may attach a speech sample file to the current note.

The Select or Unselect Note for Report pushbutton 123 is important for the report function as it allows the user, i.e. teacher, to select which of the notes in the file are to be included in a particular report. The ability to selectively include notes, rather than merely including all of the notes in the note file, is important. Many of the notes and attached speech samples could be redundant, particularly if the student has used the speech tool extensively. Further, the teacher may not want to segregate notes for different exercises in different note files, but rather store all of the notes for each client in a single file. It is easier to remember the file name by the client's name. The single note file depending on which set of notes is toggled to the selected state can be used to generate a plurality of reports. The Save Report pushbutton 125 and the Print Report pushbutton 127 are respectively used to save and print a report.

The New pushbutton 133 is used to start a new note in the current stack of notes. In one embodiment of the invention, the position of the note in order is determined by the date and time stamp of the note. Each new note would be last in the current stack. An alternative embodiment allows the user to insert the note directly after the note from which the create new note function was invoked. The position of the note in the stack of notes is shown by the index 111 in the user interface.

The First pushbutton 135, Last pushbutton 137, Previous pushbutton 139 and Next pushbutton 141 are used to navigate through the current set of notes. Thus, the clinician can review notes for a client, reading the text of the notes and attached statistics, and listening to any speech files that may be attached.

Figure 3:
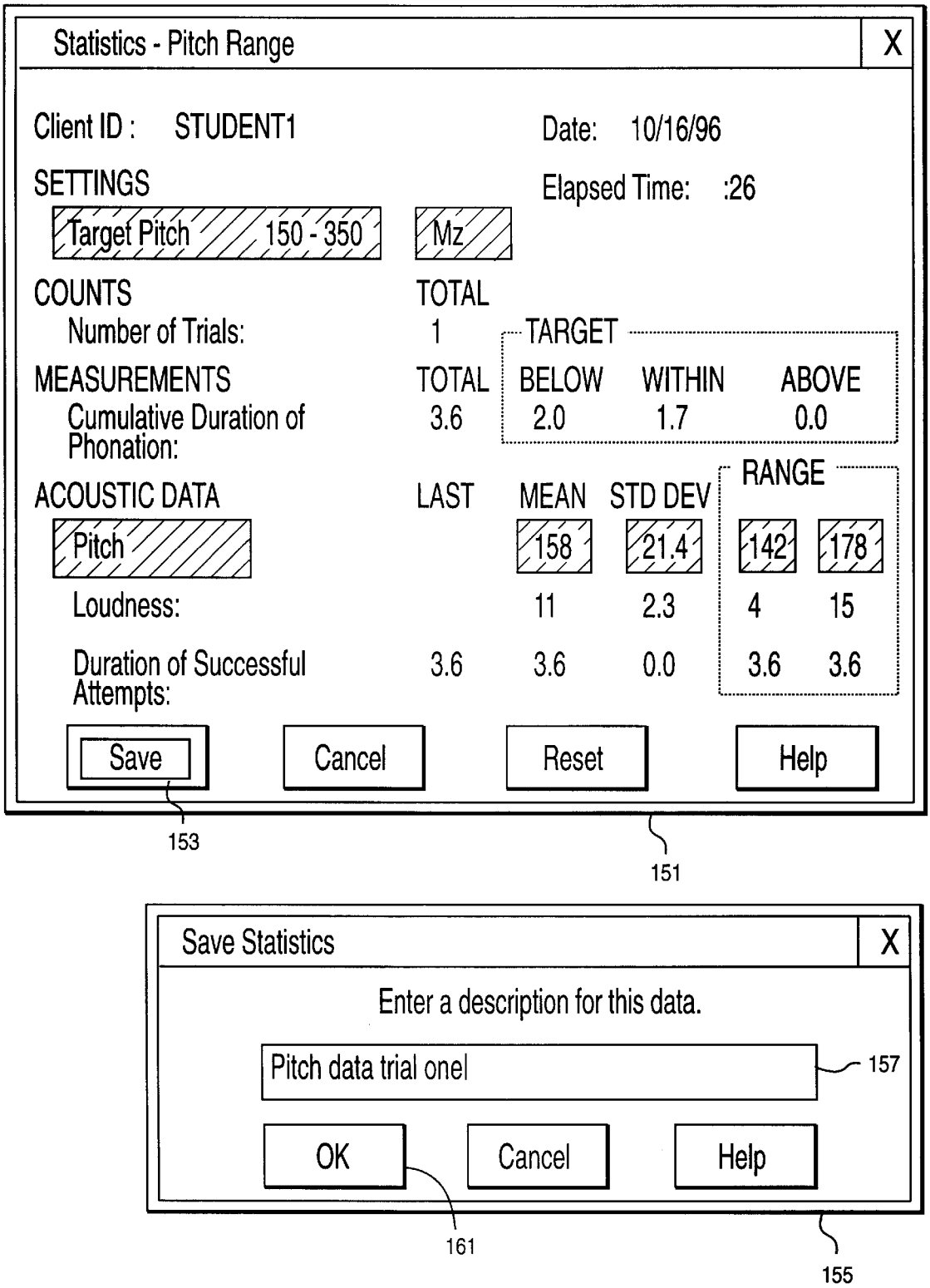
FIG. 3 shows a user interface for reporting speech statistics and adding the statistics to a note in a client's file.

As mentioned above, statistical acoustic and performance data from clinical exercises can be appended to a note file in a client subdirectory. The present invention may be used in a speech tool which performs detailed acoustic analysis on the sound produced by the client. The actual mode of analysis is irrelevant to the present invention so long as the interface presents the captured data to the user and allows the data to be selected by the user. Analysis of speech by pitch amplitude, frequency and so forth is known to the art. One preferred embodiment of the user interface of the invention is shown in FIG. 3. For example, the analog signal captured by the microphone can be digitally sampled at 22.050 KHz, clustered into groups of samples (frames) and analyzed for pitch and amplitude across several different frequency bands. Further details on one possible analysis mode are found in copending, commonly assigned patent application, Ser. No. 08/710,148, "Creating Speech Models" by Aaron et al. filed the same day as the present application which is hereby incorporated by reference.

Referring again to FIG. 3, the statistics main panel 151 is displaying the pitch and loudness data for a particular speech exercise. The statistics data can be saved by selecting the Save pushbutton 153, whereupon a popup menu will be displayed asking if the user wants to save statistics to a file or a note. If the user selects a note, a description dialog appears. If the user selects a file, the system will save the statistics in a file. A description of the data can be added in entry field 157 of panel 155. In response to the user clicking the OK pushbutton 159, the user is asked for the Password for notes access. If the correct password is given, the system copies the selected statistics to a note in the note file. The user interface accepts text to describe the speech data. The system then creates a new note containing the description and statistical data. The new note is then appended to the client's XXX.NOT file. Where multiple sets of notes exist for a particular client, a menu with the existing note files associated with the current client is made available for selection. The new statistics note is then attached to the selected note file.

As the invention is envisioned as a speech tool for speech pathology, as well as other applications, subtle changes in speech must often be objectively documented to note progress. Textual observations are subjective data, so samples of the actual speech produced which are time and date stamped are an important advance to the art. In usual clinical practice, these samples are saved on audio tape and saved in a student's paper file folder rather than integrated into a unified report.

Figure 4:
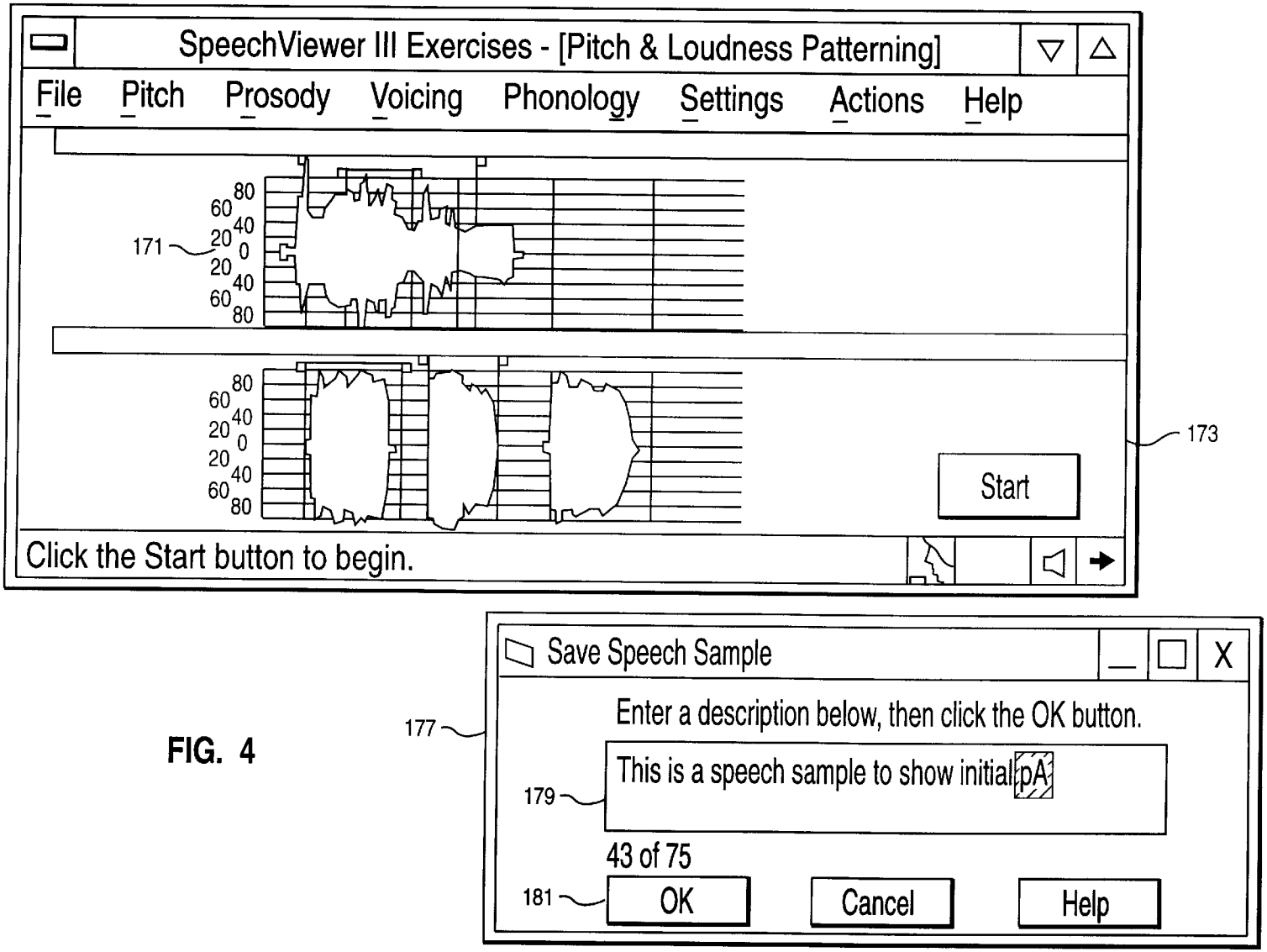
FIG. 4 depicts a user interface which depicts an audio sample to be added to a note in a client's file.

In the speech tool, speech exercises are provided for the use of the client as he is taught by the clinician. For example, one exercise in speech pathology might be the correct pronunciation of various phonemes. A voice tool might have a rhythm or musical scale exercise. In addition to the acoustical analysis described above, speech samples, can be saved from SpeechViewer's clinical exercises. FIG. 4 shows a graphical representation 171 of a sample of speech represented as amplitude vs. time in a speech tool window 173. To save the speech sample the Save menu item from the file pull down menu (not shown) is selected. This invokes a Save Speech Sample window 177 with an entry field 179 for a textual description of the speech sample can be provided.

The speech samples and description are saved as a file in the client subdirectory, e.g., a YYY.V03 file, where YYY is the name given to the file by the user when saving the file. After the file is saved by selecting the OK pushbutton 181, the speech tool displays a dialog box 183 which asks the user if the sample is to be added to a note. If "yes" is selected, the user is asked for the Password for notes access. The screen for adding new notes is presented with the name of the YYY.V03 indicated. The user can add a Note, play the speech sample, and execute other note functions. This process is described in greater detail below.

Figure 5:
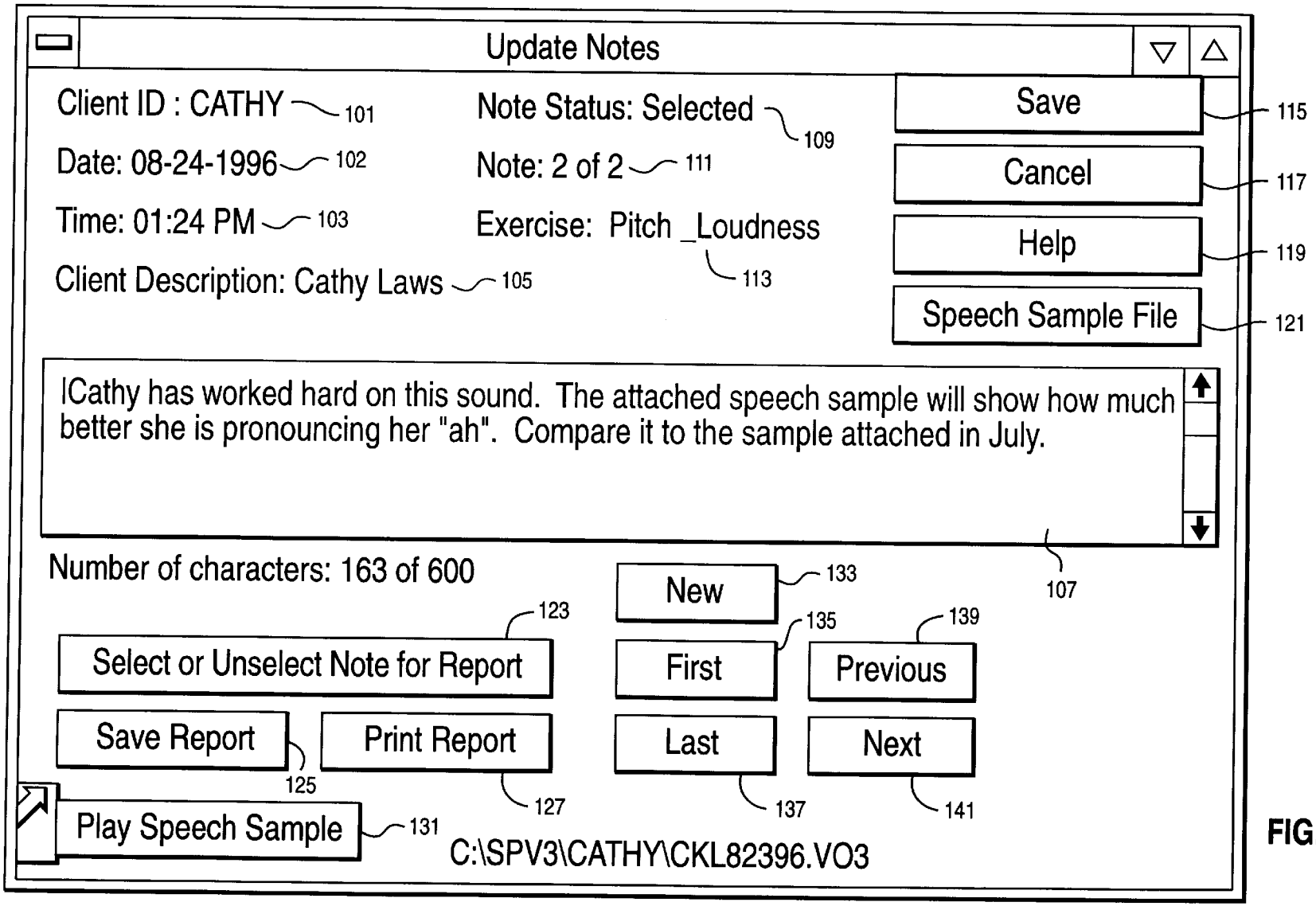
FIG. 5 is an update notes interface showing a second note in a client's file with a speech sample attached.

A second note is depicted in FIG. 5. This note indicates in the scrollable entry field 107 that the student has progressed substantially from the last note shown in FIG. 2. Note that the Note Status field 109 indicates that the note is selected. Thus, if the report function was invoked, this note would be one of the notes which would be included in the report. The presence of Play Speech Sample pushbutton 131 indicates that there is an attached speech sample which can be played by the selecting the pushbutton.

Figure 6:
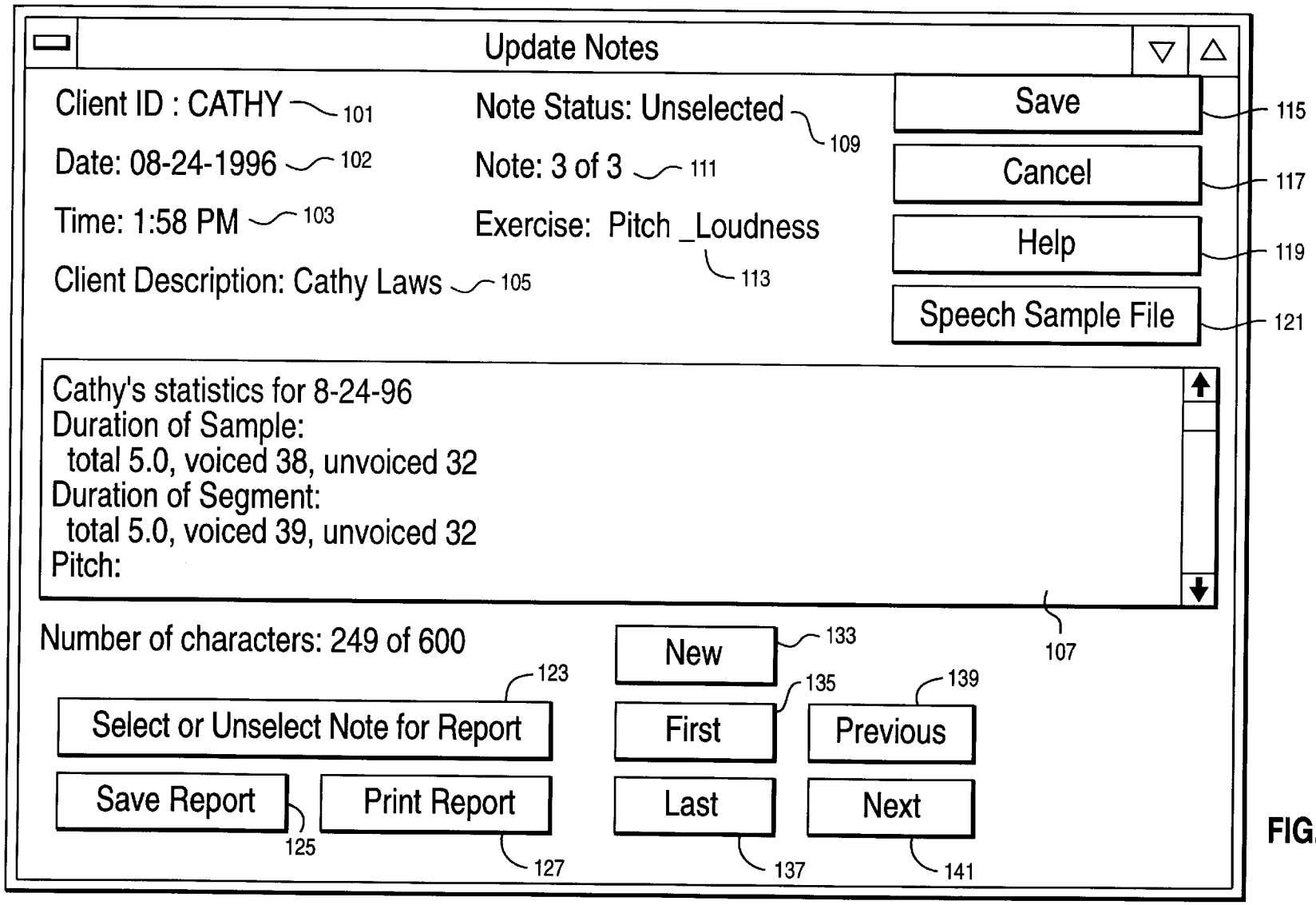
FIG. 6 is an update notes interface showing a third note in the client's file with speech statistics attached.

A third note is depicted in FIG. 6. This note contains statistics in the scrollable entry field 107 for the pitch and loudness exercise. Note that there is no Play Speech Sample pushbutton indicating that there is no attached speech sample for this note.

As mentioned above, the notes can be used for generating a report. One sample report is shown in FIG. 7. The reporting function may be one of the primary reasons for keeping notes. Clinicians may require all-inclusive reports, or they may require client-report files that can be included in another textual report. While there are many possible configurations, a report may comprise a header 201 that includes the client's and clinician's identification, along with the date that the report was generated as well as the note file and associated information from which the report was generated.

The actual speech files can also be appended to a report. However, they will only be useful if the compaction techniques used by the speech tool which uses the present invention and the report tool used to format the report are the same. Obviously, if the report generation means is integrated the speech tool there is no problem. However, there are many word processors which are favorites of respective users. Unfortunately, there is a lack of standardization in audio compaction and the industry standard *.WAV files are not compacted and thus consume too much storage.

Figure 2:
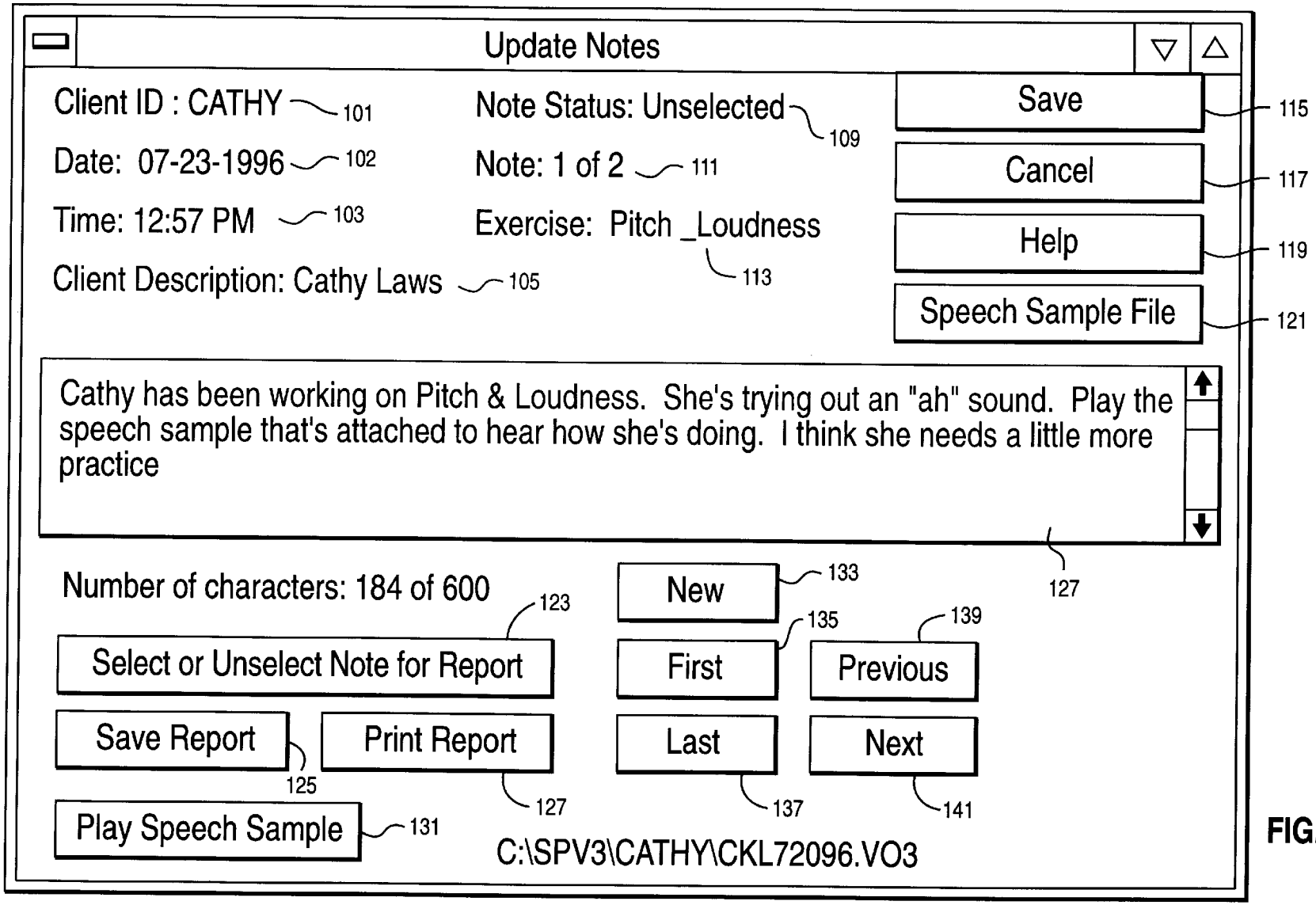
FIG. 2 shows a user interface for a note in a client's file.

As indicated above, each previously created note has a note-status field that indicates if the note currently displayed is "selected" or "unselected" for a report as shown in FIGS. 2, 5 and 6. Each append within the XXX.NOT file is tagged for inclusion in a report or not tagged depending upon the toggle effects of the "Select or Unselect Note for Report" option on the Update Notes screen. With this function, the clinician selects which notes within a given note file are to be included in a report. As shown in FIG. 7, two notes 203 and 205 were selected for inclusion within the report.

The clinician has the option of copying the header and selected notes to a file or to a printer. If the "copy to a file" option is selected, a file, e.g., *.txt, is created that can be embedded in another word processor report. If the clinician selects a "copy to a printer", a textual copy is generated.

Figure 8:
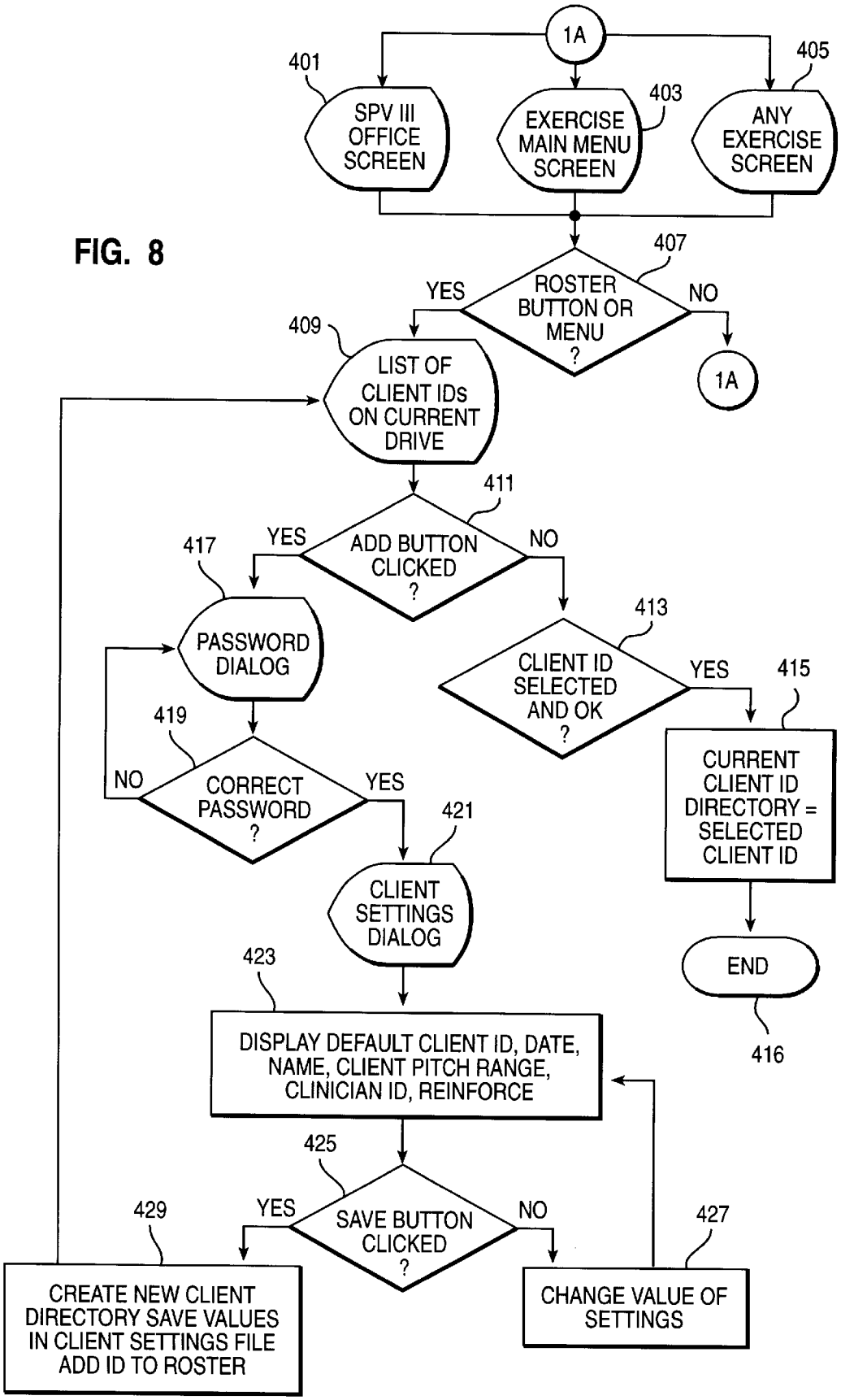
FIG. 8 is a flow diagram for the create client ID process.

FIG. 8 depicts the process for creating and/or selecting a Client ID. The process begins from an office screen, an exercise Main Menu screen, or any exercise screen, in steps 401, 403 and 405 respectively. If the Roster button or File Open Roster menu is clicked, step 407, the roster dialog box is displayed. The roster dialog box displays a list of all client ID files (*.CLI) on the current drive, step 409.

Step 411 tests if the Add button is clicked, which signifies that a new client ID is to be added. If not, in step 413, the system determines if client ID is selected and OK button clicked. If so, in step 415, the current client ID directory is set to the selected client ID. The process ends in step 416.

If the user is adding a new client ID, in step 417 a Password dialog box is displayed requesting a current password. This password is typically that of the teacher or pathologist. If correct password entered as determined by step 419, the Client settings are displayed in a dialog box in step 421.

In step 423, the default values for client ID (COMMON), date, client name, client pitch range, clinician ID, and reinforcement are displayed. The test in step 425 determines if the Save button is clicked. If not, the user is afforded an opportunity to change the values. Finally, in step 429, a new client subdirectory is created and the values in client settings file are saved. Also, in step 429, the new client ID is added to the roster list.

Figure 9A:
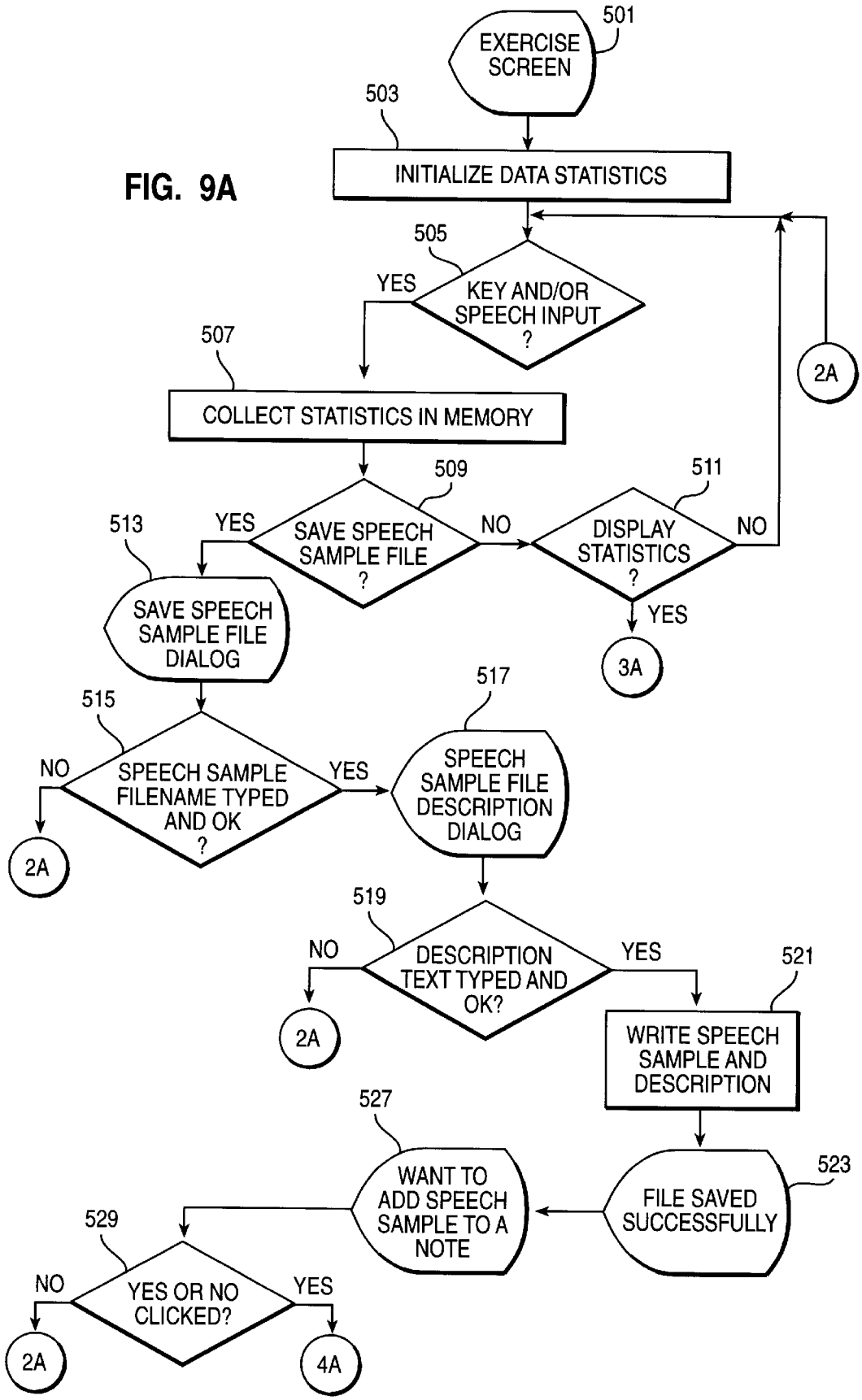
FIGS. 9A–9C are flow diagrams for the process of attaching data statistics or speech samples to notes in a client's file.
Figure 9B:
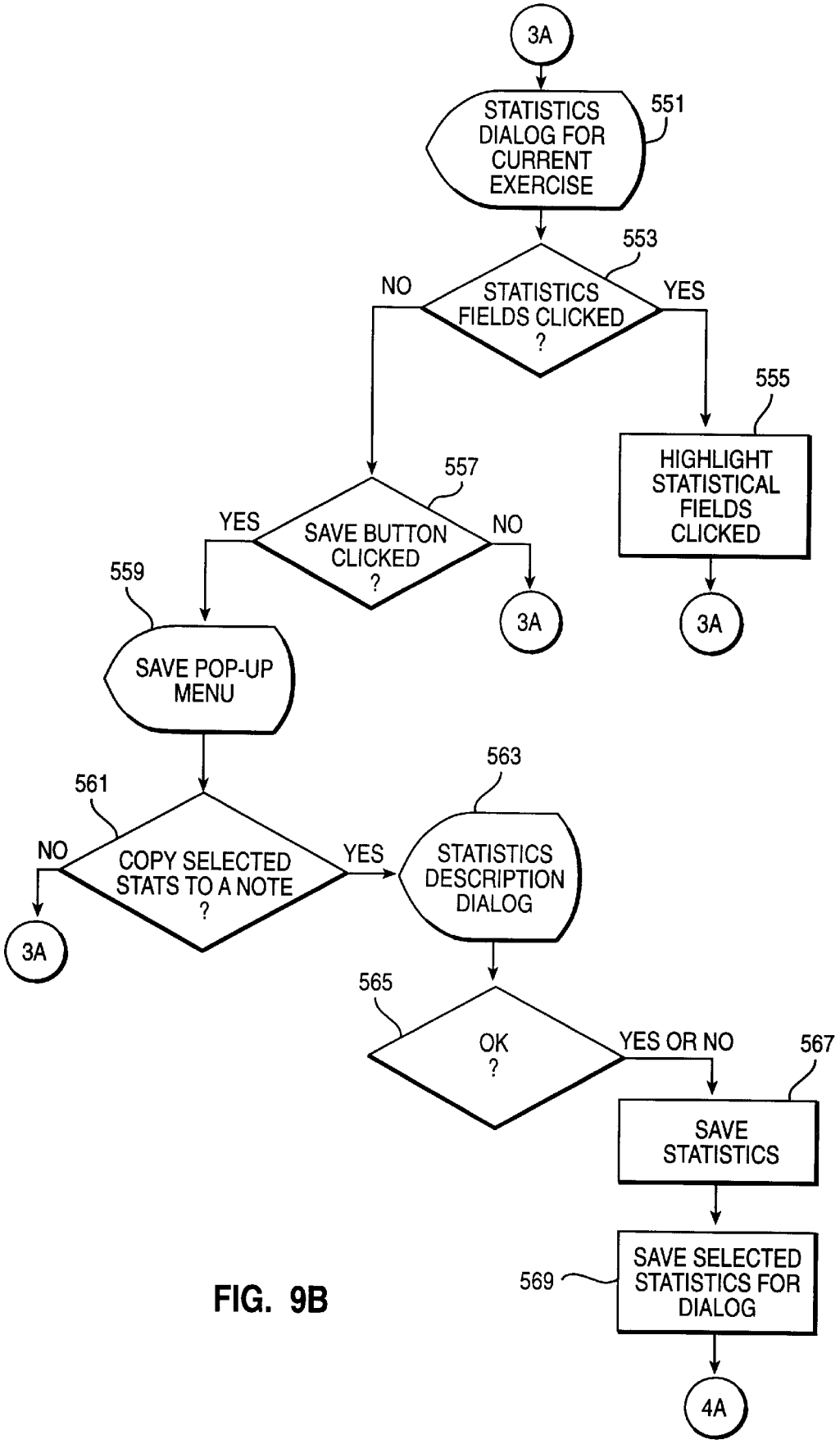
Figure 9C:
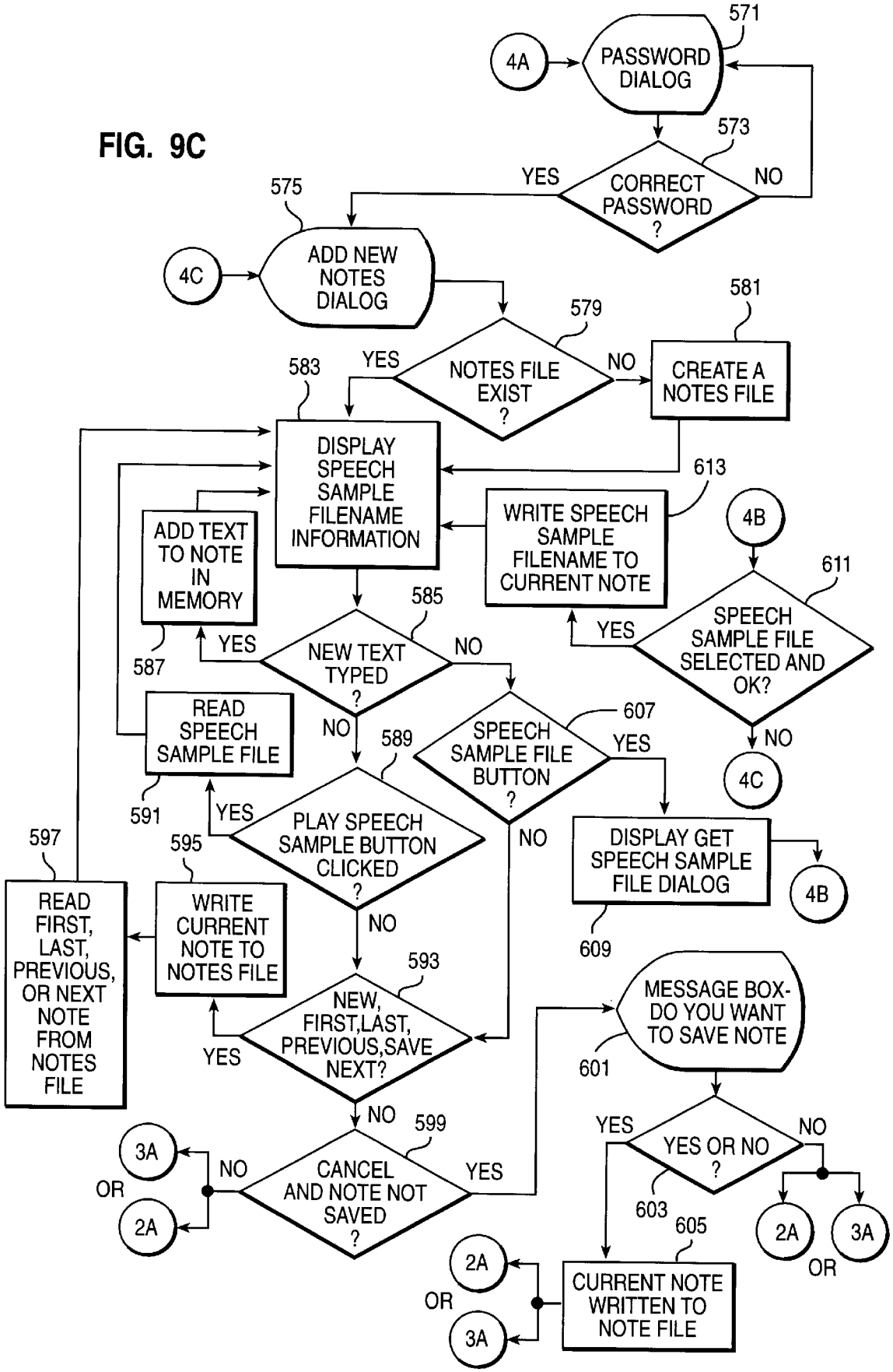

FIGS. 9A–9C show the process for collecting and saving speech data statistics and speech samples. The process begins in step 501 where an exercise is selected and the system displays an exercise screen in the graphical user interface.

In step 503, the data statistics are initialized for the exercise which in the preferred embodiment are specific to the client performing the exercise. For example, the statistics may include client ID, date, threshold settings, e.g., loudness, recognition, timing, files used, e.g., speech sample, phoneme model, elapsed time, durations of speech samples, e.g., total time, voiced time and unvoiced time. Statistics can also include acoustic data, e.g., mean, standard deviation and range of pitch, loudness, and duration of successful attempts, number of trials, target pitch range, duration of phonation, targets and obstacles hit and missed, number of onsets, voicing on and off time, percent voiced, duration of successful phonations, number and percent of recognized productions. The type of statistics which are initialized and collected during the exercise are naturally based on exercise selected.

After user input to the interface and speech input, the system collects statistics and the related speech sample in memory, step 507. If the save action on the Speech Sample File menu is selected in step 509, the system displays the Save Speech Sample File dialog box in step 513. If the save action is not selected, in step 511, a test for a request to display statistics for the exercise is performed. If the user has requested statistics, the system goes to step 551 in FIG. 9B. If not, the system continues to monitor for user input in step 505.

If speech sample file name is typed and OK button clicked, step 515, the system displays the Speech Sample file description dialog in step 517. If description text was typed and the OK button selected, step 519, the text is saved with the speech sample in memory in the current client directory, step 521. Next, in step 523, the system displays the successful save dialog. The system in step 525 waits for the OK button to be clicked. Step 527 displays a dialog box asking if the user wants to add the speech sample file to a note. If Yes is selected, then the system goes to display password dialog in step 571 in FIG. 9C. If the results from the tests in steps 515, 519, or 529 are negative, the system tests for whether the display statistics bequest is made in step 511, and then waits for user input.

Referring to FIG. 9C, in step 571, the password dialog box is displayed. If correct password entered, step 573, the system displays the Add New Notes dialog box in step 575 with the speech sample filename displayed and identified as part of a new note. In the preferred embodiment, if the notes file exists, step 579, also displayed as part of the note are the client ID, the current date and time, note number, exercise name, note status, and client description, step 583. If a notes file does not exist in the current client directory, step 579, the system creates a notes file in the current client directory in step 581.

If new text typed in entry field, step 585, the system adds it to the note in memory, step 587. The test in step 589 determines if the Play Speech Sample button is clicked. If so, step 591 reads the speech sample file and sends the speech sample to the audio device driver.

If the New, First, Last, Previous, Save, or Next button is clicked, step 593, the current note is written to the notes file (id.NOT) in the current client directory, step 595. Then, in step 597, the system reads and displays a new, first, last, previous, current, or next note from the notes file (*.NOT) in the current client directory as appropriate.

If the Cancel button clicked and the current note was not saved, step 599, a dialog box is displayed asking if the user wants to save the note in step 601. If Yes is clicked, step 603, the current note is written to the notes file in the current client directory, step 605. The system goes to step 505 in FIG. 9A where the exercise screen is redisplayed.

If new text was not typed in step 585, the system tests for whether the speech sample file button was clicked on in step 607. If the speech sample file button was selected in step 607, in step 609, the Get Speech Sample File dialog box containing a list of the saved speech sample files is displayed. Next, in step 611, the system determines whether the speech sample file is selected and the OK button is clicked. If so, in step 613, the selected speech file name is written to the current note. The process flows to step 583 where the selected speech sample file name is displayed and so forth. If the test in step 611 is negative, the process returns to step 575 where the Add New Notes dialog box is displayed.

Referring now to FIG. 9B, if the action Display Statistics menu was selected, in step 551, the system displays a dialog with statistics for current exercise. As the user selects the various statistics fields by clicking on them, step 553, the system highlights the fields on the display containing the statistics, step 555.

If the test in step 557 determines that the Save button was selected, step 559 displays a Save popup menu. If Copy Selected Statistics to a Note is selected in step 561, the system displays the Statistics Description dialog in step 563.

If OK is clicked, step 565, step 567 saves the statistics description in memory to display in a note. Step 569 saves highlighted statistics for later display in a notes dialog box.

The process proceeds to FIG. 9C where the password dialog is displayed. The process generally follows that described above except that the Add New Notes dialog box is displayed with the Statistics Description text and the selected statistics displayed in a scrollable multi-line edit field rather than speech sample.

The process for adding or updating notes is very similar to that depicted FIG. 9C. The main difference is that the process may begin from the roster dialog screen, the main menu or the office screen, as well as from an exercise screen. If a Notes button is clicked from the office screen or the roster dialog or the File Edit Notes menu is selected from the office screen, or the Notes procedure is otherwise invoked, the system begins the password dialog as depicted in FIG. 9C.

Since the note generated from this entry point is not associated with a current exercise, if the user wants to attach speech data statistics or a speech file, he must know the name of the file to do so.

Figure 10A:
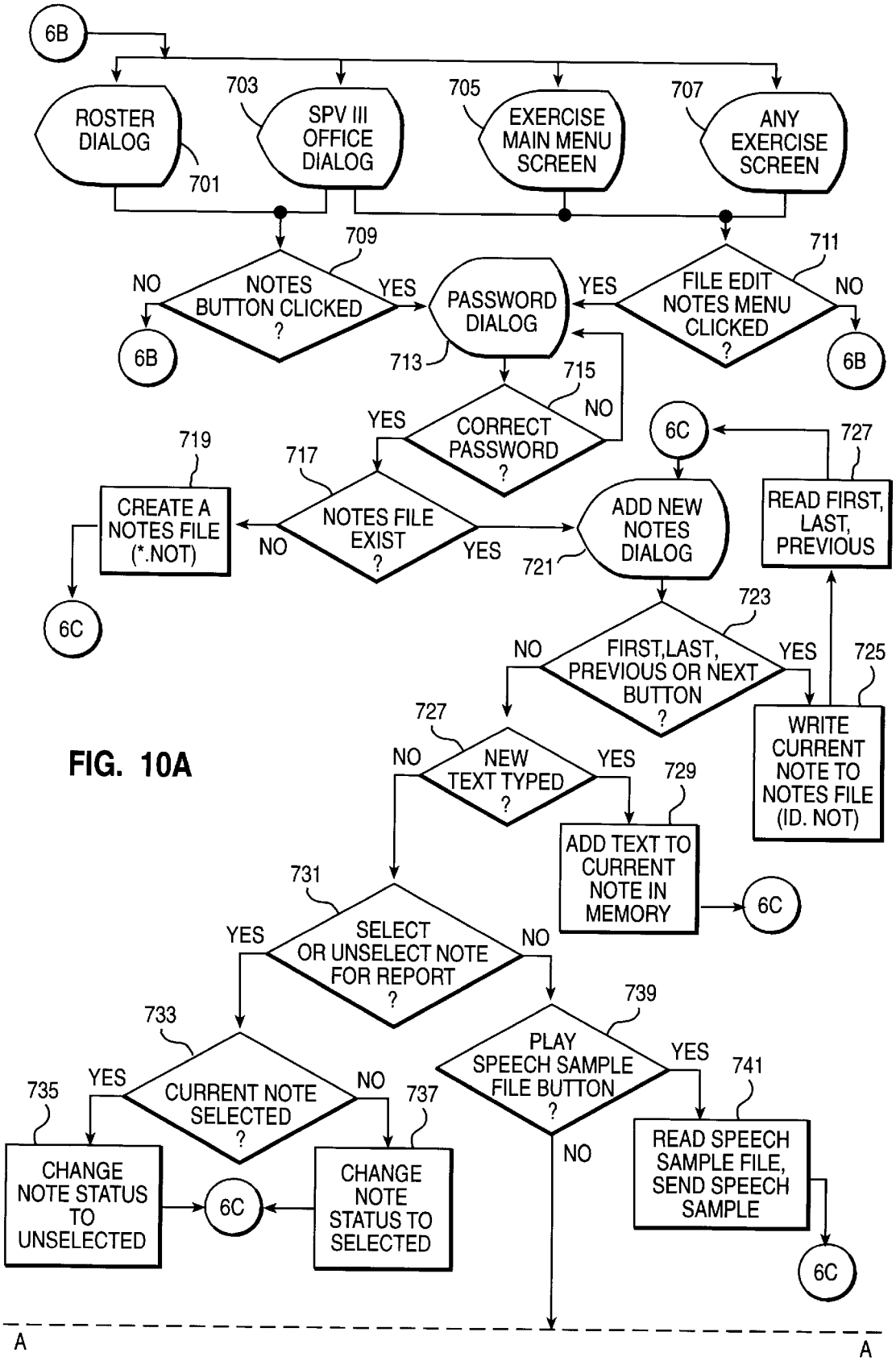
FIG. 10(A–B) shows a flow diagram for creating reports in the present invention.
Figure 10B:
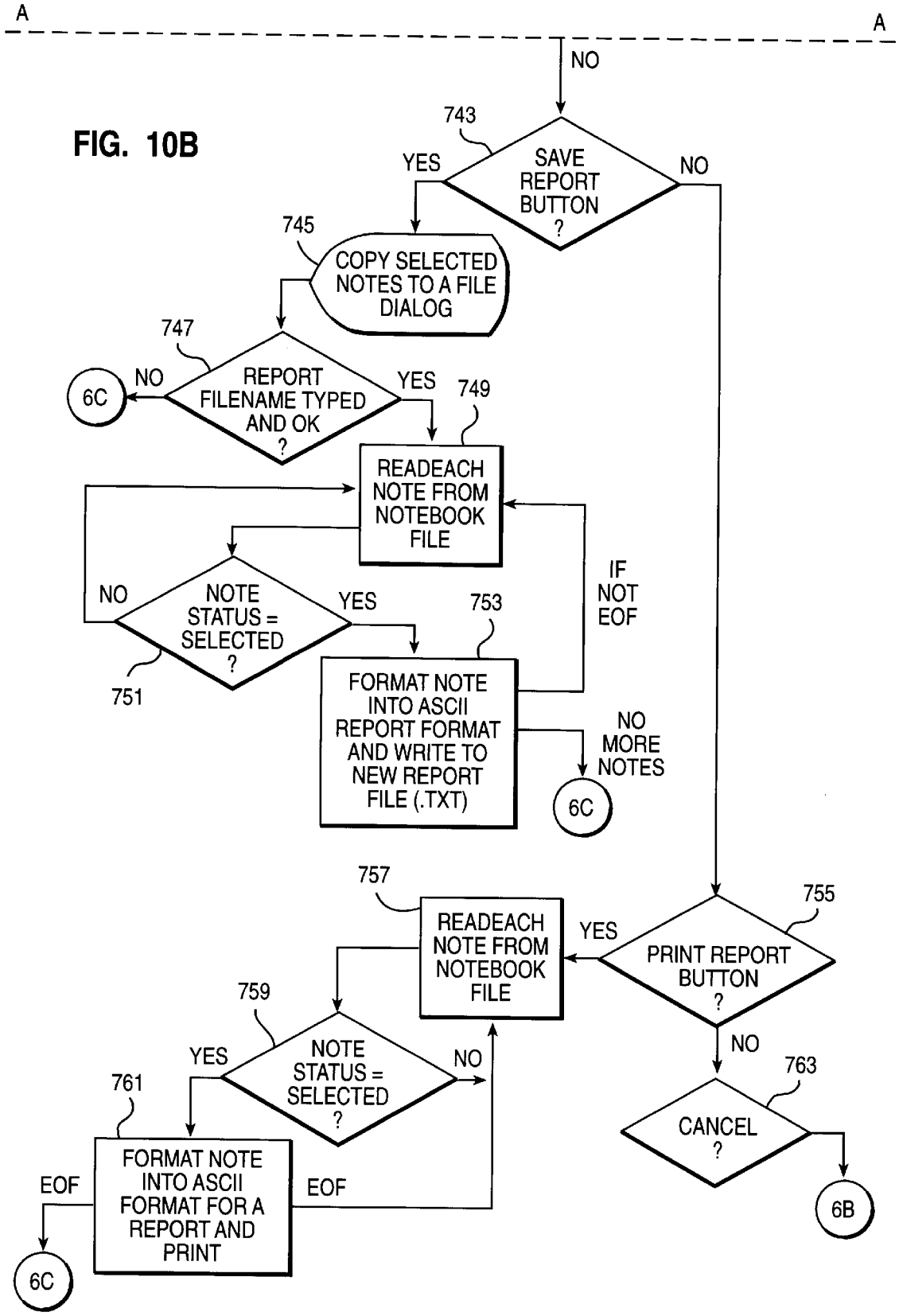

The process for creating reports is shown in FIG. 10. The process begins where the system displays the roster dialog, the office dialog, an exercise main menu screen or any exercise screen in steps 701 through 707. If the test in step 709 determines that a Notes button is clicked from the Office screen or the Roster dialog or the test in step 711 determines that the File Edit Notes menu is clicked from the Office screen, Exercise Main Menu screen, or any exercise, the system displays the password dialog box in step 713.

If correct password is entered, step 715, and the notes file exists, step 717, the system displays the Add New Notes dialog box with the cursor placed in a scrollable multi-line edit field ready for entering text for a new note, step 721. If the notes file does not exist, one is created in the current client directory, step 719.

If the First, Last, Previous, or Next button is selected, step 723, the system writes the current note to the notes file in the current client directory in step 725. Next, the system reads and displays the first, last, previous, or next note from the notes file (*.NOT) in the current client directory as appropriate. If new text is typed, step 727, the text is added to the current note in memory, step 729.

If the Select or Unselect Note for Report button is selected, step 731, and if the current note status is selected, step 733, the system changes the status to unselected in step 735. Otherwise, the current note status is unselected so the system changes the status to selected in step 737.

If a speech sample filename is identified as part of the note and the Play Speech Sample button is selected, step 739, the system reads the speech sample file and sends the speech sample to the operating system audio device driver step 741.

If the Save Report button is clicked, step 743, the system displays the Copy Selected Notes to a File dialog box, step 745. If a report file name was typed and OK button clicked, step 747, the system reads each note from the notebook file in the current client directory, step 749. If a note has a status of selected, step 751, the system formats this note into an ASCII report format and writes this note to the new report file. If the report file already exists, a dialog may be displayed to the user to ask if it should be replaced. If yes, replace the existing file.

If the Print Report button is clicked, step 755, then the system reads each note from the notebook file in the current client directory in step 757. If a note has a status of selected, step 759, the system formats this note into an ASCII report format and sends this note to the printer, step 761. If the cancel button is selected and current note not saved, step 763, a dialog is displayed asking if the user wants to save the note. If Yes is clicked, the current note is written to the notes file in the current client directory and the originating screen where the user selected the notes action is displayed.

The following features and advantages separate the present invention from the prior art. The invention provides an advanced, automated notes taking procedure which can used in clinics and schools for speech training. The invention can be analogized to a set of index cards each with a respective note. Separate ones of the notes can be selected for inclusion in a report. Captured speech samples can be electronically attached to a note for playback in reviewing the notes. Data captured from speech exercises can be attached to or otherwise incorporated in a note. Further, the data can be embedded into a clinical report that can be printed or included in another report.

While one of the primary advantages of the note system described above is to chart the progress of a student in learning a particular speech skill, the invention also finds use to teach a beginning teacher. An experienced teacher can create example note files of the various exercises which the beginning clinician can use to understand the exercises as well as the type and rate of progress which a client might be expected to make. Example: Note files can also be packaged with the speech tool as produced by the application developer.

While the invention has been shown and described with reference to particular embodiments thereof, it will be understood by those skilled in the art that the invention can be practiced, with modification, in other environments. For example, although the invention described above can be conveniently implemented in a general purpose computer selectively reconfigured or activated by software, those skilled in the art would recognize that the invention could be carried out in hardware, in firmware or in any combination of software, firmware or hardware including a special purpose apparatus specifically designed to perform the described invention. Therefore, changes in form and detail may be made therein without departing from the spirit and scope of the invention as set forth in the accompanying claims.

We claim:

1. A method for documenting human speech production, comprising the steps of:

responsive to user input, storing a set of notes in a computer memory, each of the set of notes comprising textual information descriptive of human speech produced by a first student during a speech training session;

responsive to user input, attaching a set of digitized speech samples each produced by the first student during a speech training session to selected ones of the set of notes;

analyzing human speech produced at one respective time by the first student during a speech training session to produce speech statistics;

responsive to user input, storing the speech statistics for presentation in a note in the set of notes;

wherein the set of notes can be sequentially displayed in a user interface of a computer.

2. The method as recited in claim 1 further comprising the steps of:

responsive to user input, selecting notes within the set of notes;

creating a first report; and incorporating the selected notes within the first report.

3. The method as recited in claim 2 further comprising the step of printing the first report.

4. The method as recited in claim 2 further comprising the steps of:

unselecting at least some selected notes;

selecting other notes in the set of notes;

creating a second report incorporating the currently selected notes;

wherein the notes respectively incorporated in the first and second reports are different subsets of the set of notes.

5. The method as recited in claim 1 further comprising the steps of:

responsive to user input, creating a student subdirectory for the first student, the student subdirectory associated with a student ID;

linking the student subdirectory to a current computer session when the first student logs on with a student ID; and storing notes created during the current computer session in a set of notes in the subdirectory associated with the student ID.

6. The method as recited in claim 1 further comprising the steps of:

responsive to a request to store a note, querying for a teacher password; and responsive to an input of an authorized teacher password, storing the note in a set of notes associated with a student ID.

7. The method as recited in claim 6 further comprising the step of time stamping each note when stored in the set of notes.

8. The method as recited in claim 6 further comprising the steps of:

responsive to a request to update a note, querying for a teacher password; and responsive to an input of an authorized teacher password, updating the note in the set of notes associated with the student ID.

9. A system for documenting human speech production, comprising:

a memory for storing a set of notes and a set of instructions for executing a documentation process, each of the set of notes comprising textual information descriptive of human speech produced by a first student during a speech training session;

means for capturing and digitizing human speech produced by the first student during a speech training session;

means for attaching digitized speech samples to selected ones of the set of notes;

means for analyzing digitized speech samples to produce speech statistics;

means for incorporating the speech statistics for presentation in a note in the set of notes;

a display for sequentially displaying the set of notes in a user interface of a computer; and a speaker for playing selected speech samples attached to the set of notes.

10. The system as recited in claim 9 further comprising:

means responsive to user input for selecting notes within the set of notes;

means for creating a first report; and means for incorporating the selected notes within the first report.

11. The system as recited in claim 10 further comprising a printer for printing the first report.

12. The system as recited in claim 9 further comprising an indexing means for ordering the set of notes, wherein the user interface displays a location of a respective note in the set of notes.

13. The system as recited in claim 12 further comprising an insertion means for inserting a new note in the set of notes.

14. The system as recited in claim 12 wherein the notes are ordered by the indexing means according to a time stamp generated at creation of a note.

15. A computer program product in a computer readable medium for documenting human speech production, comprising:

means responsive to user input for creating a set of notes, each of the set of notes comprising textual information descriptive of human speech produced by a first student during a speech training session, wherein digitized speech samples of human speech produced by the first student are attached to selected ones of the set of notes;

means for capturing and digitizing human speech produced by the first student during a speech training session to produce digitized speech samples;

means for presenting a user interface for sequentially displaying the set of notes of a computer thus documenting the progress of the first student, wherein the user interface also includes means for selecting an attached speech sample to be played; and means for playing selected speech samples attached to the set of notes.

16. The product as recited in claim 15 further comprising:

means for analyzing at least one of the digitized speech samples to produce speech statistics; and means for incorporating the speech statistics for presentation in a note in the set of notes.

17. The product as recited in claim 16 further comprising:

means responsive to user input for selecting notes within the set of notes;

means for creating a first report; and means for incorporating the selected notes within the first report.

18. The product as recited in claim 17 wherein the product is a product for speech pathologists to document the speech of a speech impaired client and further comprises:

means for displaying a speech exercise in the user interface;

means for capturing speech from the speech exercise in a speech file;

means for initiating the notes creation means from the speech exercise;

wherein notes initiated from the speech exercise contain a name of the speech exercise.

19. The product as recited in claim 15 further comprising password creation means for creating student IDs, teacher IDs and teacher passwords and wherein a teacher password is required for creating or updating a note in the set of notes.

20. The product as recited in claim 19 wherein a plurality of sets of notes are created, each set of notes associated with a respective student ID.

21. The product as recited in claim 20 further comprising:

means for conducting a plurality of speech exercises;

means for capturing speech from a speech exercise in a speech file;

means for initiating the notes creation means from a speech exercise;

wherein notes initiated from a respective speech exercise contain a name of the respective speech exercise and are stored in a set of notes associated with the respective speech exercise and a student ID.

22. The product as recited in claim 15 further comprising:

means for conducting a plurality of speech exercises; and sets of notes with attached digitized speech samples providing examples of respective ones of the speech exercises.

* * * * *